US005320424A

United States Patent [19]

Annett et al.

[11] Patent Number: 5,320,424

[45] Date of Patent: Jun. 14, 1994

[54] APPARATUS FOR DELIVERING A RAPIDLY SETTING COMPOSITION

[75] Inventors: Martin F. Annett, Oxford; Barry France, Rotheram; John R. Powell, Milton Keynes, all of Great Britain

[73] Assignee: FOSROC International Ltd., Nechells, United Kingdom

[21] Appl. No.: 994,850

[22] Filed: Dec. 22, 1992

[30] Foreign Application Priority Data

Jun. 22, 1990 [GB] United Kingdom ..... 9013919

[51] Int. Cl.[5] ..... B28C 7/04

[52] U.S. Cl. ..... 366/8; 366/152; 366/338

[58] Field of Search ..... 366/2, 6, 8, 16, 17, 366/152, 151, 160, 161, 132, 131, 336, 337, 338

[56] References Cited

U.S. PATENT DOCUMENTS 3,584,977 6/1971 Coleman .
3,700,140 10/1972 Harvey .
4,019,653 4/1977 Scherer .
4,117,547 9/1978 Mathis ..... 366/17
4,209,258 6/1980 Oakes .

FOREIGN PATENT DOCUMENTS 0056146 7/1982 European Pat. Off. .
0112638 7/1984 European Pat. Off. .
3037182 10/1981 Fed. Rep. of Germany .
3160322 7/1982 Fed. Rep. of Germany .
3623390 5/1987 Fed. Rep. of Germany .
3906577 6/1990 Fed. Rep. of Germany .
2302789 10/1976 France .
2400946 3/1979 France .
0390257 4/1933 United Kingdom .
2050854 1/1981 United Kingdom .

*Primary Examiner*—Robert W. Jenkins

[57] ABSTRACT

This invention relates to apparatus for producing and delivering a rapidly setting composition and method of delivering a rapid setting cementitious grout. The rapidly setting composition comprises a first interactive component and a second interactive component. The first component comprises a retarded cementitious grout and the second is a gelling agent therefor, the rate of addition of the gelling agent being selected so as to control the rate of set of the deliverable composition. The particular apparatus includes means for supplying the gelling agent through an auxiliary pipeline to the main supply pipeline and means for monitoring the flow rate of the first component through the main supply line, means for monitoring the flow rate of the gelling agent through the auxiliary supply line, and means for adjusting the flow rate of the gelling agent to reduce difference between the monitored value and a reference value. The method is characterized by the steps of monitoring the flow rate of the grout through the main supply pipeline and monitoring the flow rate of the gelling agent through the auxiliary pipeline and by comparing the monitored flow rate of the gelling agent with a reference flow rate selected according to the predetermined rate of set of the grout including the gelling agent, and adjusting the flow rate of the gelling agent to eliminate any difference between the monitored and reference values.

6 Claims, 1 Drawing Sheet

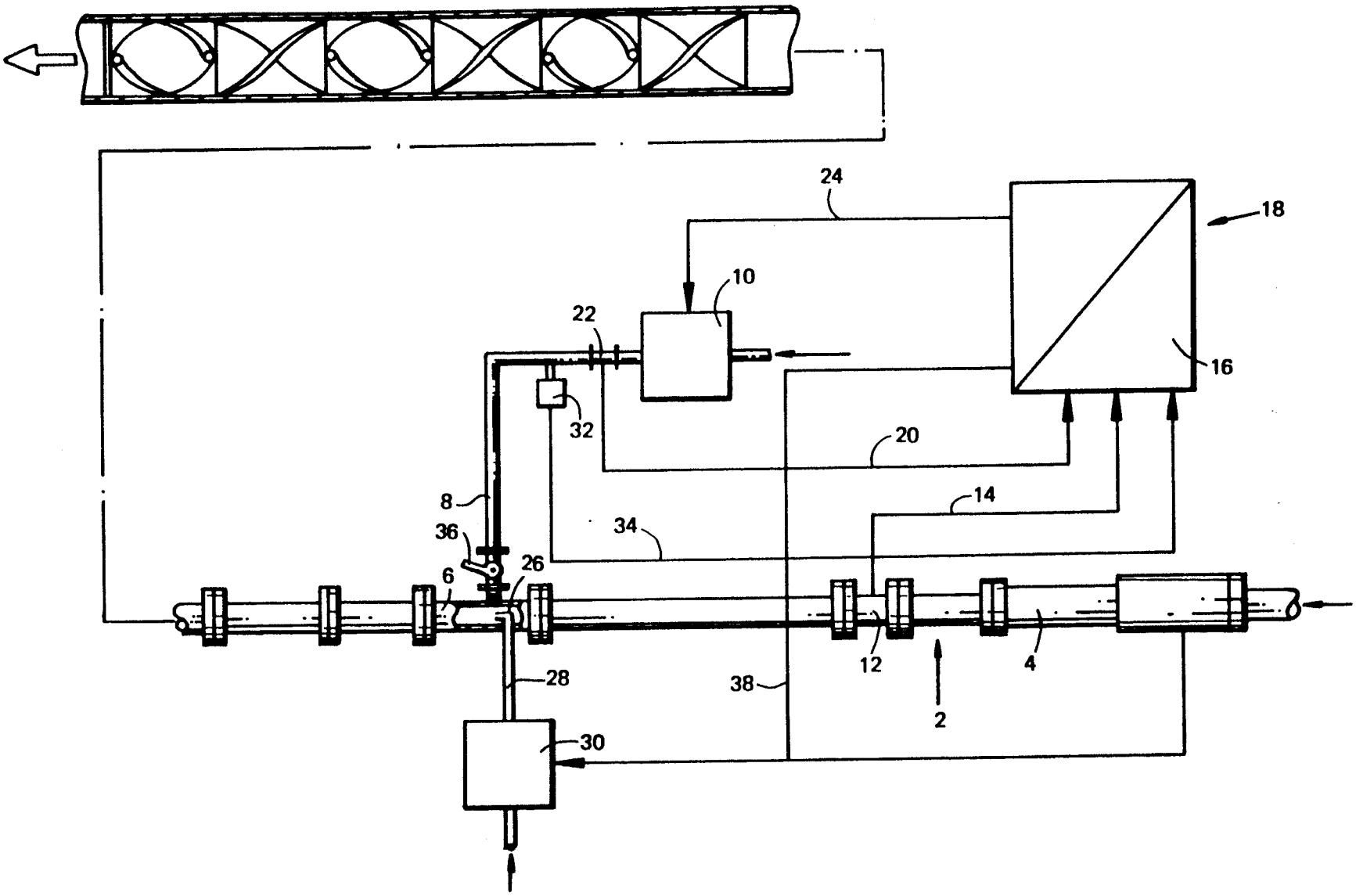
18
16
4
14
2
20
12
24
10
38
34
22
32
30
28
26
8
36
6

APPARATUS FOR DELIVERING A RAPIDLY SETTING COMPOSITION

This invention relates to apparatus for producing and delivering a rapidly setting composition which comprises a first interactive component and a second interactive component. The first component comprises a retarded cementitious grout and the second is a gelling agent therefor, the rate of addition of the gelling agent being selected so as to control the rate of set of the delivered composition. As an example, the invention is applicable to the placement of grout (or concrete), in the clearance between segments of a lining to a tunnel and the facing tunnel bore wall or backfilling in a mine or the like. In some situations the rate of flow of water in the tunnel is so high that conventional grouts are washed away before they have had time to set. Increasing the rate at which the grout sets incurs the risk that the grout may prematurely set in the mixing and supply apparatus.

It is known to add to the cementitious material a set retarder and to add an activating or gelling agent just before it is applied, the rate of addition of the activator being selected to achieve a predetermined set time. The effect of the gelling agent depends on the proportion present in the mixture. Too much and the grout will set prematurely to block the supply apparatus.

Too little and it will not set quickly enough so that the placed grout is washed away. Another variable factor is the position of the lance through which the grout including gelling agent is delivered: as the lance is moved up or down the static head will vary and this will affect the rate of delivery of the mixed grout and the individual supplies.

According to the invention in one aspect there is provided apparatus for delivering a rapid setting composition to a place of use, the composition comprising a first interactive component comprising a grout comprising cement, water and retarder and a second interactive component which is a gelling agent therefor, the apparatus comprising means for supplying the first interactive component through a main supply pipeline, means for supplying the gelling agent through an auxiliary pipeline to the main supply pipeline, the main supply line being connected to a delivery lance the position of which may be varied as the composition is delivered at the place of use, the supply pipeline including at the delivery end thereof an in-line static mixer by which the components are mixed, characterised by the presence of means for monitoring the flow rate of the first component through the main supply line and means for monitoring the flow rate of the gelling agent through the auxiliary supply line, and means for adjusting the flow rate of the gelling agent to reduce difference between the monitored value and a reference value.

In accordance with a second aspect of the invention, there is provided apparatus as defined, including nozzle means inside the main supply pipeline connectable to a pressurised supply of a flushing agent to flush the main supply pipeline at or downstream of the position at which the agent auxiliary line is connected to the supply pipeline.

The grout and the activating agent are mixed by passing them through an inline static mixer at the delivery end of the supply pipeline. The gelling agent component is selected according to the nature of the self-setting ingredients of the grout. Most preferably the gelling agent is one or more of a sodium silicate, aluminium sulphate or magnesium sulphate or the like. Because such agents tend to be rapid acting, the grout contains an anti-washout retarder, e.g. a water-soluble natural or synthetic polymer which will surround particles of the cement or other self-setting material to protect such particles from being washed out by the static or flowing water present in the void. By adjustment of the quantity of the retarder, the quantity of the gelling agent relative to the dry cement or other hydraulic ingredients can be up to say 8%, preferably 3 or 4%, better to control the rate of placement.

The cement may be a cement such as Ordinary Portland cement and a pozzolanic or like material such as pulverised fly ash, blast furnace slag or the like may be present in the grout. Sand and/or aggregates and fillers, e.g. bentonize may be present. Preferably the retarder is selected so that the grout may be held in a holding tank for several hours, e.g. six. The anti-washout retarder may be a hydroxeyethyl cellulose ether or the like. The quantity of the anti-washout retarder will be about 0.5% by weight, relative to the cement or other dry hydraulic ingredients. Additives may be present provided that they do not significantly affect the rate of set or strength development of the cement composition. It is preferred to add an anti-foaming agent, to prevent air entrainment which would weaken the set material.

A problem in delivering rapid setting material is that it must be flushed from the delivery apparatus at the end of each delivery operation or placement or it will set solid in the delivery lance. Merely connecting a water supply line to the supply pipeline and flushing through with water can prove unreliable. As a result, delivery lances become blocked and have to be discarded.

In accordance with another aspect of the invention there is provided: apparatus as defined above including nozzle means inside the main supply pipeline connectable to a pressurised supply of a flushing agent, to flush the supply pipeline at or down stream of the position at which the agent auxiliary pipeline is connected to the main supply pipeline.

Often the water pressure available in a tunnel or other place of use is too low or variable to flush properly even with the nozzle. In yet another aspect the apparatus therefore preferably includes a water pump for increasing or providing the pressure of the water supply to the nozzle means; means for sensing the pressure in the auxiliary pipeline; and means for deactivating the water pump when the pressure in the auxiliary line is below a predetermined threshold and for activating the water pump when the pressure in the agent supply is above a predetermined threshold. The unintentional addition of flushing water to a grout to be delivered is thereby prevented.

In another aspect the invention provides a method of delivering a rapid setting cementitious grout to a place of use via a delivery lance the position of which may be varied as the composition is delivered, the rate of setting being maintained substantially constant, the method comprising the steps of supplying through a main supply pipeline a grout comprising a water, cement and a set retarder;

supplying a gelling agent for the grout through an auxiliary pipeline connected to the main supply pipeline and mixing the grout and the gelling agent by passing these through an in-line static mixer at the delivery end of the main supply line, characterised by the steps of monitoring the flow rate of the grout through the main supply pipeline and monitoring the flow rate of the gelling agent through the auxiliary pipeline and by comparing the monitored flow rate of the gelling agent with a reference flow rate selected according to the predetermined rate of set of the grout including the gelling agent, and adjusting the flow rate of the gelling agent to eliminate any difference between the monitored and reference values.

In another aspect the invention provides a method as defined, including the step of placing nozzle means in the main supply pipeline at a location upstream of the position where the auxiliary pipeline joins the supply pipeline, connecting to the nozzle means to a pressurised supply of a flushing agent, and flushing the agent through the supply pipeline; and preferably including a pump for increasing the pressure of the flushing agent supplied to the nozzle means, sensing the pressure in the auxiliary pipeline is below a predetermined threshold and activating the pump when the pressure is above a predetermined threshold.

One embodiment of the invention will now be described, by way of example, with reference to the accompanying drawing which is a schematic representation of apparatus embodying the invention.

A cementitious grout comprising cement, water and a set retarder, together with other optional additives (except a gelling agent is supplied through a main supply pipeline generally indicated at 2. The material flows from right to left in the drawing to one or more lances (not illustrated) which are used to place it in the clearance between a tunnel lining segment and its bore hole wall. In order to provide sufficient pressure at the lance(s) a pump 4 is provided, shown as a two stage pump. It is desirable that the output of the pump is substantially free of pulses in the pressure and flow rate.

A solution of the gelling agent to cause setting of the grout is added to the main supply line 2 from an auxiliary pipeline 8 which joins the main supply pipeline 2 at a location 6, (shown partly in section), at the forward end. The gelling agent is provided under pressure by an agent pump 10.

The rate at which the grout flows in the supply line 2 may be varied by pump controls (not shown) for the pump 4. The rate will also vary as the lance is placed in lower positions, at the bottom of the tunnel, or higher positions, at the roof of the tunnel, due to the variation in the static head so produced.

It is important that the rate at which the gelling agent is added is controlled to accommodate changes in the flow rate of grout otherwise the setting rate will vary undesirably. To this end, a flow meter 12 is placed in the supply pipeline to provide a signal representing the flow rate, via line 14, to a programmed logic unit (PLU) 16 of a control system 13. The PLU 16 also receives a signal representing the flow rate of the gelling agent, via line 20 from a magnetic flow meter 22 in the agent line 8.

A reference input to the PLU may be set by means not illustrated, to represent a desired proportion of gelling agent according to the required rate of set. The PLU compares suitably scaled versions of the reference signal and the signal representing the flow rate of the gelling agent and produces an output signal on line 24 to control the agent pump 10 so as to reduce any difference.

Because the mixture supplied to the lances gels so quickly, it is important to flush the mixture thoroughly from the apparatus after each operation. To this end, a nozzle 26, supplied by water line 28, is provided inside the portion 6 at the position at which the agent auxiliary line 8 is connected. Supplying water under pressure via the nozzle 6 thus more effectively cleans the inside of the supply pipeline 2 and lance(s) at and down stream of the connection. A pump 30 is present to ensure that the water is delivered at a predetermined rate.

A pressure sensor 32 sends a signal over line 34 to the PLU 16. If the signal indicates that the pressure in the agent line 8 is below a predetermined threshold, this is interpreted as indicating that the operator is using the apparatus and the pump 30 is deactivated. If the signal produced by pressure sensor 32 indicates that the pressure in the agent line 8 is above a predetermined threshold, this is interpreted as meaning that the operator has finished and has closed a valve 36 shutting off the supply of the gelling agent. In response, the PLU 16 activates the water pump 30 via line 38 and deactivates the grout pump. The operator can then actuate the supply of flushing water to the nozzle 26 to clear out material from the forward end of the pipeline 2 and the associated lances.

We claim:

1. Apparatus for delivering a rapid setting composition to a place of use, the composition comprising a first interactive component comprising a grout comprising cement, water and retarder and a second interactive component which is a gelling agent therefor, the apparatus comprising means for supplying the first interactive component through a main supply pipeline, means for supplying the gelling agent through an auxiliary pipeline to the main supply pipeline, the main supply line being connected to a delivery lance the position of which may be varied as the composition is delivered at the place of use, the supply pipeline including at the delivery end thereof an in-line static mixer by which the components are mixed, characterised by the presence of means for monitoring the flow rate of the first component through the main supply line and means for monitoring the flow rate of the gelling agent through the auxiliary supply line, and means for adjusting the flow rate of the gelling agent to reduce difference between the monitored value and a reference value.

2. Apparatus according to claim 1, characterised by nozzle means inside the main supply pipeline connectable to a pressurised supply of a flushing agent to flush the main supply pipeline at or downstream of the position at which the agent auxiliary line is connected to the supply pipeline.

3. Apparatus according to claim 2, including a pump for increasing or providing the pressure of the flushing agent to the nozzle means; means for sensing the pressure in the auxiliary pipeline; and means for deactivating the pump when the pressure in the auxiliary pipeline is below a predetermined threshold and for activating the pump when the pressure in the auxiliary pipeline is above a predetermined threshold.

4. A method of delivering a rapid setting cementitious grout to a place of use via a delivery lance the position of which may be varied as the composition is delivered, the rate of setting being maintained substantially constant, the method comprising supplying through a main supply pipeline a grout comprising a water, cement and a set retarder;

supplying a gelling agent for the grout through an auxiliary pipeline connected to the main supply pipeline and mixing the grout and the gelling agent by passing these through an in-line static mixer at the delivery end of the main supply line, characterised by the steps of monitoring the flow rate of the grout through the main supply pipeline and monitoring the flow rate of the gelling agent through the auxiliary pipeline and by comparing the monitored flow rate of the gelling agent with a reference flow rate selected according to the predetermined rate of set of the grout including the gelling agent, and adjusting the flow rate of the gelling agent to eliminate any difference between the monitored and reference values.

5. A method according to claim 4 including the step of placing nozzle means in the main supply pipeline at a location upstream of the position where the auxiliary pipeline joins the supply pipeline, connecting to the nozzle means to a pressurised supply of a flushing agent, and flushing the flushing agent through supply pipeline.

6. A method according to claim 5, comprising including the step of pumping the flushing agent supplied to the nozzle means, sensing the pressure in the auxiliary pipeline, and deactivating the pump when the pressure in the auxiliary pipeline is below a predetermined threshold and activating the pump when the pressure is above a predetermined threshold.

* * * * *